US009497840B2

(12) United States Patent
Wehrens

(10) Patent No.: US 9,497,840 B2
(45) **Date of Patent: *Nov. 15, 2016**

(54) SYSTEM AND METHOD FOR CREATING AND UTILIZING DUAL LASER CURTAINS FROM A SINGLE LASER IN AN LPP EUV LIGHT SOURCE

(71) Applicant: ASML Netherlands B.V., Veldhoven (NL)

(72) Inventor: Martijn Wehrens, Waalre (NL)

(73) Assignee: ASML Netherlands B.V., Veldhoven (NL)

( * ) Notice: Subject to any disclaimer, the term of this patent is extended or adjusted under 35 U.S.C. 154(b) by 345 days.

This patent is subject to a terminal disclaimer.

(21) Appl. No.: 14/174,280

(22) Filed: Feb. 6, 2014

(65) Prior Publication Data

US 2015/0083936 A1 Mar. 26, 2015

Related U.S. Application Data

(63) Continuation-in-part of application No. 14/037,817, filed on Sep. 26, 2013, now Pat. No. 9,241,395, and a continuation-in-part of application No. 14/137,030, filed on Dec. 20, 2013, now Pat. No. 8,809,823.

(51) Int. Cl.
*H05G 2/00* (2006.01)

(52) U.S. Cl.
CPC ..... *H05G 2/008* (2013.01); *H05G 2/006* (2013.01)

(58) Field of Classification Search
CPC ..... H05G 2/00; H05G 2/001; H05G 2/003; H05G 2/005; H05G 2/006; H05G 2/008; G03F 7/70033; G01N 2015/1075; G21K 5/00; G21K 5/10
USPC ..... 250/504 R, 573, 574
See application file for complete search history.

(56) References Cited

U.S. PATENT DOCUMENTS 5,359,620 A * 10/1994 Akins ..... H01S 3/0346 372/58
6,414,747 B1 * 7/2002 Hardy ..... F42B 35/00 273/371
6,542,234 B1 * 4/2003 Ulrich ..... A24B 1/04 250/559.21

(Continued)

FOREIGN PATENT DOCUMENTS

WO 2013050212 A1 4/2013

*Primary Examiner* — John Lee
(74) *Attorney, Agent, or Firm* — Gard & Kaslow LLP

(57) ABSTRACT

A method and apparatus for creating and utilizing dual laser curtains from a single laser source in a laser produced plasma (LPP) extreme ultraviolet (EUV) light system is disclosed. A polarizing beam splitter creates two beams of orthogonal polarization from a single laser, and the beams are used to generate two laser curtains. Sensors detect flashes from droplets of target material as they pass through the curtains. One sensor may detect the position of the droplets relative to a desired trajectory to the irradiation site so that the orientation of a droplet generator may be adjusted to direct subsequent droplets to the irradiation site, as in the prior art. A second sensor may detect each droplet as it passes through a curtain to determine when a source laser should generate a pulse so that the pulse will arrive at the irradiation site at the same time as the droplet, so that a signal may be sent to the source laser to fire at the correct time.

19 Claims, 5 Drawing Sheets

(56) References Cited

U.S. PATENT DOCUMENTS 7,038,764 B2 * 5/2006 Lee ..... A63B 24/0021 273/333
7,068,367 B2 * 6/2006 Stobrawa ..... H05G 2/008 356/318
7,087,914 B2 * 8/2006 Akins ..... B82Y 10/00 250/493.1
7,164,144 B2 * 1/2007 Partlo ..... B82Y 10/00 250/493.1
7,250,621 B2 * 7/2007 Gaebel ..... H05G 2/008 250/504 R
7,872,245 B2 * 1/2011 Vaschenko ..... H05G 2/003 156/345.24
8,000,212 B2 * 8/2011 Senekerimyan ..... G01J 1/429 250/504 R
8,138,487 B2 * 3/2012 Vaschenko ..... H05G 2/003 250/504 R
8,263,953 B2 * 9/2012 Fomenkov ..... H05G 2/005 250/493.1
8,324,600 B2 * 12/2012 Hayashi ..... H05G 2/006 250/493.1
8,519,366 B2 * 8/2013 Bykanov ..... G03F 7/70033 250/396 ML
8,575,575 B2 * 11/2013 Partlo ..... H05G 2/003 250/504 R
8,653,491 B2 * 2/2014 Partlo ..... H05G 2/003 250/504 R
8,809,823 B1 * 8/2014 Senekerimyan ..... H05G 2/008 250/504 R
8,847,183 B2 * 9/2014 Partlo ..... H05G 2/003 250/504 R
9,241,395 B2 * 1/2016 Senekerimyan ..... H05G 2/008
2004/0089825 A1 * 5/2004 Schwenke ..... B01L 3/0268 250/573
2005/0258768 A1 * 11/2005 Gaebel ..... H05G 2/008 315/111.81
2007/0002474 A1 * 1/2007 Amemiya ..... B82Y 10/00 359/857
2008/0073598 A1 * 3/2008 Moriya ..... H05G 2/001 250/504 R
2009/0230326 A1 * 9/2009 Vaschenko ..... H05G 2/003 250/492.2
2010/0027006 A1 * 2/2010 Hertens ..... G01F 1/667 356/335
2010/0032590 A1 2/2010 Bykanov et al.
2010/0140512 A1 * 6/2010 Suganuma ..... G03F 7/70033 250/504 R
2010/0258747 A1 10/2010 Vaschenko et al.
2010/0258748 A1 * 10/2010 Vaschenko ..... H05G 2/003 250/504 R
2010/0258749 A1 * 10/2010 Partlo ..... H05G 2/003 250/504 R
2010/0258750 A1 10/2010 Partlo et al.
2010/0327192 A1 * 12/2010 Fomenkov ..... G03F 7/70033 250/504 R
2011/0141865 A1 * 6/2011 Senekerimyan ..... G01J 1/429 369/47.15
2011/0248191 A1 * 10/2011 Fomenkov ..... H05G 2/005 250/504 R
2012/0286176 A1 11/2012 Rajyaguru et al.
2013/0037693 A1 * 2/2013 Moriya ..... G02B 27/16 250/201.2
2013/0062539 A1 * 3/2013 Hayashi ..... H05G 2/006 250/504 R
2013/0105713 A1 * 5/2013 Watanabe ..... H05G 2/008 250/504 R
2014/0048099 A1 * 2/2014 Partlo ..... H05G 2/003 134/1.1
2014/0103229 A1 * 4/2014 Chroback ..... H05G 2/003 250/504 R
2014/0126043 A1 * 5/2014 Senekerimyan ..... H01J 35/18 359/361
2014/0306115 A1 * 10/2014 Kuritsyn ..... G02B 27/0006 250/358.1
2015/0083898 A1 * 3/2015 Senekerimyan ..... H05G 2/006 250/214.1
2015/0083936 A1 * 3/2015 Wehrens ..... H05G 2/006 250/504 R

* cited by examiner

SYSTEM AND METHOD FOR CREATING AND UTILIZING DUAL LASER CURTAINS FROM A SINGLE LASER IN AN LPP EUV LIGHT SOURCE

This application is a continuation-in-part of U.S. patent application Ser. No. 14/037,817, filed Sep. 26, 2013, entitled "System and Method for Controlling Droplet Timing in an LPP EUV Light Source," and Ser. No. 14/137,030, filed Dec. 20, 2013, entitled "System and Method for Controlling Droplet Timing and Steering in an LPP EUV Light Source."

FIELD OF THE INVENTION

The present invention relates generally to laser produced plasma extreme ultraviolet light sources. More specifically, the invention relates to a method and apparatus for irradiating droplets of target material in an LPP EUV light source.

BACKGROUND OF THE INVENTION

The semiconductor industry continues to develop lithographic technologies which are able to print ever-smaller integrated circuit dimensions. Extreme ultraviolet ("EUV") light (also sometimes referred to as soft x-rays) is generally defined to be electromagnetic radiation having wavelengths of between 10 and 120 nm. EUV lithography is currently generally considered to include EUV light at wavelengths in the range of 10-14 nm, and is used to produce extremely small features, for example, sub-32 nm features, in substrates such as silicon wafers. These systems must be highly reliable and provide cost effective throughput and reasonable process latitude.

Methods to produce EUV light include, but are not necessarily limited to, converting a material into a plasma state that has one or more elements, e.g., xenon, lithium, tin, indium, antimony, tellurium, aluminum, etc., with one or more emission line(s) in the EUV range. In one such method, often termed laser produced plasma ("LPP"), the required plasma can be produced by irradiating a target material, such as a droplet, stream or cluster of material having the desired line-emitting element, with a laser pulse at an irradiation site. The target material may contain the spectral line-emitting element in a pure form or alloy form, for example, an alloy that is a liquid at desired temperatures, or may be mixed or dispersed with another material such as a liquid.

A droplet generator heats the target material and extrudes the heated target material as droplets which travel along a trajectory to the irradiation site to intersect the laser pulse. Ideally, the irradiation site is at one focal point of a reflective collector. When the laser pulse hits the droplets at the irradiation site, the droplets are vaporized and the reflective collector causes the resulting EUV light output to be maximized at another focal point of the collector.

In earlier EUV systems, a laser light source, such as a $CO_2$ laser source, is on continuously to direct a beam of light to the irradiation site, but without an output coupler so that the source builds up gain but does not lase. When a droplet of target material reaches the irradiation site, the droplet causes a cavity to form between the droplet and the light source and causes lasing within the cavity. The lasing then heats the droplet and generates the plasma and EUV light output. In such "NoMO" systems (called such because they do not have a master oscillator) no timing of the arrival of the droplet at the irradiation site is needed, since the system only lases when a droplet is present there.

However, it is necessary to track the trajectory of the droplets in such systems to insure that they arrive at the irradiation site. If the output of the droplet generator is on an inappropriate path, the droplets may not pass through the irradiation site, which may result in no lasing at all or reduced efficiency in creating EUV energy. Further, plasma formed from preceding droplets may interfere with the trajectory of succeeding droplets, pushing the droplets out of the irradiation site.

Some prior art NoMo systems accomplish such tracking of the droplets by passing a low power laser through lenses to create a "curtain," i.e., a thin plane of laser light through which the droplets pass on the way to the irradiation site. When a droplet passes through the plane, a flash is generated by the reflection of the laser light of the plane from the droplet. The location of the flash may be detected to determine the trajectory of the droplet, and a feedback signal sent to a steering mechanism to redirect the output of the droplet generator as necessary to keep the droplets on a trajectory that carries them to the irradiation site.

Other prior art NoMo systems improve on this by using two curtains between the droplet generator and the irradiation site, one closer to the irradiation site than the other. Each curtain is typically created by a separate laser. The flash created as a droplet passed through the first curtain may, for example, be used to control a "coarse" steering mechanism, and the flash from the second curtain used to control a "fine" steering mechanism, to provide greater control over correction of the droplet trajectory than when only a single curtain is used.

More recently, NoMO systems have generally been replaced by "MOPA" systems, in which a master oscillator and power amplifier form a source laser which may be fired as and when desired, regardless of whether there is a droplet present at the irradiation site or not, and "MOPA PP" ("MOPA with pre-pulse") systems in which a droplet is sequentially illuminated by more than one light pulse. In a MOPA PP system, a "pre-pulse" is first used to heat, vaporize or ionize the droplet and generate a weak plasma, followed by a "main pulse" which converts most or all of the droplet material into a strong plasma to produce EUV light emission.

One advantage of MOPA and MOPA PP systems is that the source laser need not be on constantly, in contrast to a NoMO system. However, since the source laser in such a system is not on constantly, firing the laser at an appropriate time so as to deliver a droplet and a main laser pulse to the desired irradiation site simultaneously for plasma initiation presents additional timing and control problems beyond those of prior systems. It is not only necessary for the main laser pulses to be focused on an irradiation site through which the droplet will pass, but the firing of the laser must also be timed so as to allow the main laser pulses to intersect the droplet when it passes through that irradiation site in order to obtain a good plasma, and thus good EUV light. In addition, in a MOPA PP system, the pre-pulse must target the droplet very accurately, and at a slightly different location than the irradiation site.

What is needed is an improved way of controlling both the trajectory of the droplets and the timing with which they arrive at the irradiation site, so that when the source laser is fired it will irradiate the droplets at the irradiation site.

SUMMARY OF THE INVENTION

Disclosed herein are a method and apparatus for controlling the trajectory and timing of droplets of target material in an EUV light source.

In one embodiment, a system is disclosed for timing the firing of a source laser in an extreme ultraviolet laser produced plasma (EUV LPP) light source having a droplet generator which releases a droplet at an estimated speed, the source laser firing pulses at an irradiation site, comprising: a droplet illumination module comprising a single line laser configured to generate a first laser curtain and a second laser curtain, the first and second laser curtains being of orthogonal polarizations and each located between the droplet generator and the irradiation site; a droplet detection module comprising a first sensor configured to detect a flash when the droplet passes through the first laser curtain; a first controller configured to: determine, based upon the flash as detected by the first sensor, a known distance from the first curtain to the irradiation site, and the estimated speed of the droplet, a time when the source laser should fire a pulse so as to irradiate the droplet when the droplet reaches the irradiation site; and generate a timing signal instructing the source laser to fire at the determined time; a second sensor configured to detect the flash when the droplet passes through the second laser curtain; and a second controller configured to determine, based upon the flash as detected by the second sensor, that the droplet is not on a desired trajectory leading to the irradiation site and providing a signal indicating an adjustment to a direction in which the droplet generator releases a subsequent droplet which will place the subsequent droplet on the desired trajectory.

Another embodiment discloses a method for timing the firing of a source laser in an EUV LPP light source having a droplet generator which releases a droplet at an estimated speed, the source laser firing pulses at an irradiation site, comprising: generating from a single laser source a first laser curtain and a second laser curtain, the first and second laser curtains having polarizations orthogonal to each other and located between the droplet generator and the irradiation site; detecting by a first sensor a flash when the droplet passes through the first laser curtain; determining from the flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory; detecting by a second sensor the flash when the droplet passes through the second laser curtain; and determining, based upon the flash as detected by the second sensor, a known distance from the first curtain to the irradiation site, and the estimated speed of the droplet, a time when the source laser should fire a pulse so as to irradiate the droplet when the droplet reaches the irradiation site, and generating a timing signal instructing the source laser to fire at the determined time.

Still another embodiment discloses a non-transitory computer readable storage medium having embodied thereon instructions for causing a computing device to execute a method for timing the firing of a source laser in an EUV LPP light source having a droplet generator which releases a droplet at an estimated speed, the source laser firing pulses at an irradiation site, the method comprising: generating from a single laser source a first laser curtain and a second laser curtain, the first and second laser curtains having polarizations orthogonal to each other and located between the droplet generator and the irradiation site; detecting by a first sensor a flash when the droplet passes through the first laser curtain; determining from the flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory; detecting by a second sensor the flash when the droplet passes through the second laser curtain; and determining, based upon the flash as detected by the second sensor, a known distance from the first curtain to the irradiation site, and the estimated speed of the droplet, a time when the source laser should fire a pulse so as to irradiate the droplet when the droplet reaches the irradiation site, and generating a timing signal instructing the source laser to fire at the determined time.

DETAILED DESCRIPTION OF THE INVENTION

The present application describes a method and apparatus for improved control of the trajectory and timing of droplets in a laser produced plasma (LPP) extreme ultraviolet (EUV) light system.

In one embodiment, a droplet illumination module generates two laser curtains for detecting the droplets of target material. Both curtains are used for detecting the position of the droplets relative to a desired trajectory to the irradiation site in order to allow steering of the droplets. If both curtains are operating, one may be used for "coarse" steering and one for "fine" steering as in prior art NoMo systems. However, in some embodiments, either curtain may be used independently for steering, thus allowing for continued steering of droplets should one curtain fail to function for some reason.

One of the curtains is also used to determine when the source laser should generate pulses so that a pulse arrives at the irradiation site at the same time as each droplet. A droplet detection module detects the droplets as they pass through one of the curtains and determines when the source laser should fire a pulse to hit each droplet at the irradiation site.

The two curtains are generated by a single laser. To accomplish this, the beam of the laser is split into two linearly polarized components, each of which is polarized orthogonally to the other. One such component is used to generate a first curtain, and the other component is used to generate the other curtain. The sensor associated with each curtain contains a filter which allows the sensor to detect light from only the desired curtain, and also suppresses light from the plasma.

In the case of a MOPA PP source laser, the combination of a pre-pulse and main pulse are hereafter referred to as a single pulse, as the time between them is much shorter than the time between successive pulses in a MOPA source laser. Further, the pre-pulse is followed by the main pulse quickly enough that, when properly timed, both will hit a droplet, the main pulse hitting the droplet at the irradiation site and the pre-pulse at a location slightly before the irradiation site in the droplet trajectory. How to properly irradiate a droplet with both a pre-pulse and main pulse in this fashion is known to those of ordinary skill in the art.

Figure 1:
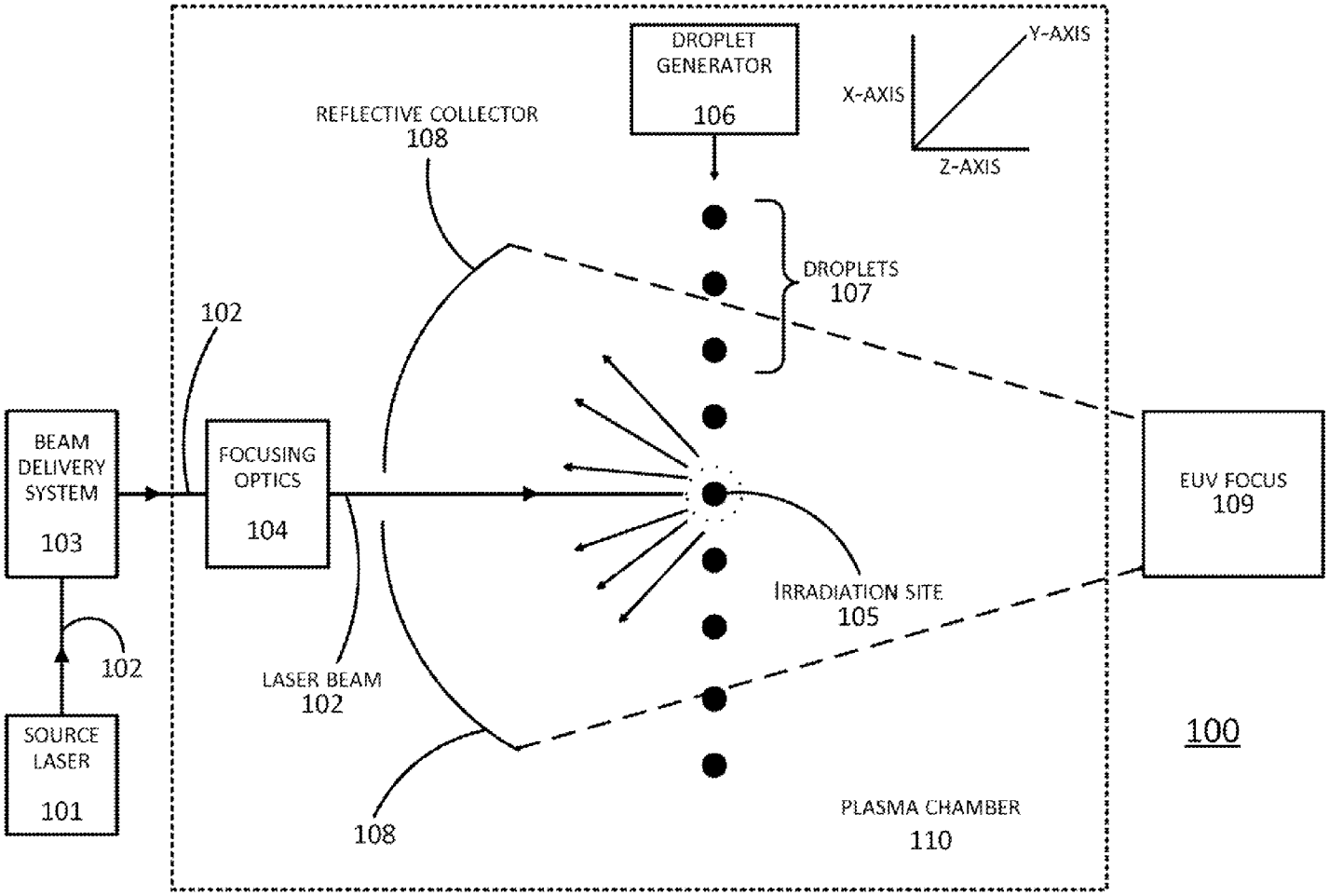
FIGURE 1 (Prior art)
FIG. 1 is an illustration of some of the components of a typical prior art embodiment of an LPP EUV system.

FIG. 1 illustrates a cross-section of some of the components of a typical LPP EUV system 100 as is known in the prior art. A source laser 101, such as a $CO_2$ laser, produces a laser beam (or a series of pulses) 102 that passes through a beam delivery system 103 and through focusing optics 104. Focusing optics 104 may, for example, be comprised of one or more lenses or mirrors, and has a nominal focal spot at an irradiation site 105 within a plasma chamber 110. A droplet generator 106 produces droplets 107 of an appropriate target material that, when hit by laser beam 102, produces a plasma which emits EUV light. In some embodiments, there may be multiple source lasers 101, with beams that all converge on focusing optics 104.

Irradiation site 105 is preferably located at a focal spot of collector 108, which has a reflective interior surface and focuses the EUV light from the plasma at EUV focus 109, a second focal spot of collector 108. For example, the shape of collector 108 may comprise a portion of an ellipsoid. EUV focus 109 will typically be within a scanner (not shown) containing pods of wafers that are to be exposed to the EUV light, with a portion of the pod containing wafers currently being irradiated being located at EUV focus 109.

For reference purposes, three perpendicular axes are used to represent the space within the plasma chamber 110 as illustrated in FIG. 1. The vertical axis from the droplet generator 106 to the irradiation site 105 is defined as the x-axis; droplets 107 travel generally downward from the droplet generator 106 in the x-direction to irradiation site 105, although in some cases the trajectory of the droplets may not follow a straight line. The path of the laser beam 102 from focusing optics 104 to irradiation site 105 in one horizontal direction is defined as the z-axis, and the y-axis is defined as the horizontal direction perpendicular to the x-axis and the z-axis.

As above, in some prior art embodiments, a closed-loop feedback control system may be used to monitor the trajectory of the droplets 107 so that they arrive at irradiation site 105. Such a feedback system again typically comprises a laser (for example, a line or fiber laser, and different from source laser 101) which generates a planar curtain between the droplet generator 106 and irradiation site 105, for example by passing the beam from the laser through a combination of spherical and cylindrical lenses. One of skill in the art will appreciate how the planar curtain is created, and that although described as a plane, such a curtain does have a small but finite thickness.

Figure 2:
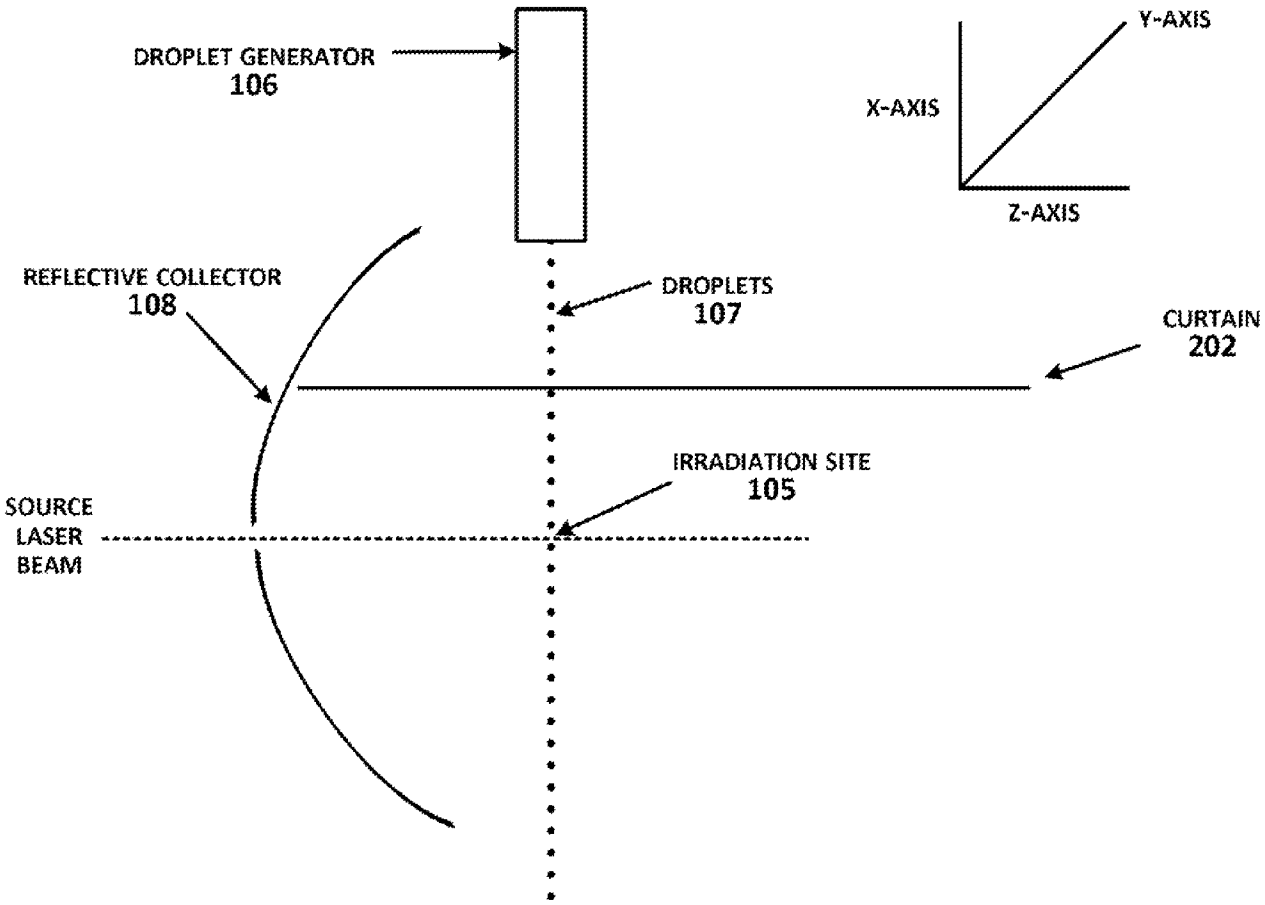
FIGURE 2 (Prior art)
FIG. 2 is a simplified illustration showing some of the components of another prior art embodiment of an LPP EUV system.

FIG. 2 is a simplified illustration showing some of the components of a prior art LPP EUV system such as is shown in FIG. 1, with the addition of a planar curtain 202 which may be created by a laser (not shown) as described above. Curtain 202 extends primarily in the y-z plane, i.e., the plane defined by the y- and z-axes (but again has some thickness in the x-direction), and is located between the droplet generator 106 and irradiation site 105.

When a droplet 107 passes through curtain 202, the reflection of the laser light of curtain 202 from the droplet 107 creates a flash which may be detected by a sensor (in some prior art embodiments this is called a narrow field, or NF, camera, not shown) and allows the droplet position along the y- and/or z-axis to be detected. If the droplet 107 is on a trajectory that leads to the irradiation site 105, here shown as a straight line from the droplet generator 106 to irradiation site 105, no action is required.

However, if the droplet 107 is displaced from the desired trajectory in either the y- or z-direction, a logic circuit determines the direction in which the droplets should move so as to reach irradiation site 105, and sends appropriate signals to one or more actuators to re-align the outlet of droplet generator 106 in a different direction to compensate for the difference in trajectory so that subsequent droplets will reach irradiation site 105. Such feedback of the droplet trajectory may be performed on a droplet-by-droplet basis, and correction implemented on the trajectory within the mechanical adjustment capability of the equipment. The manner of such feedback and correction are known to one of skill in the art.

Figure 3:
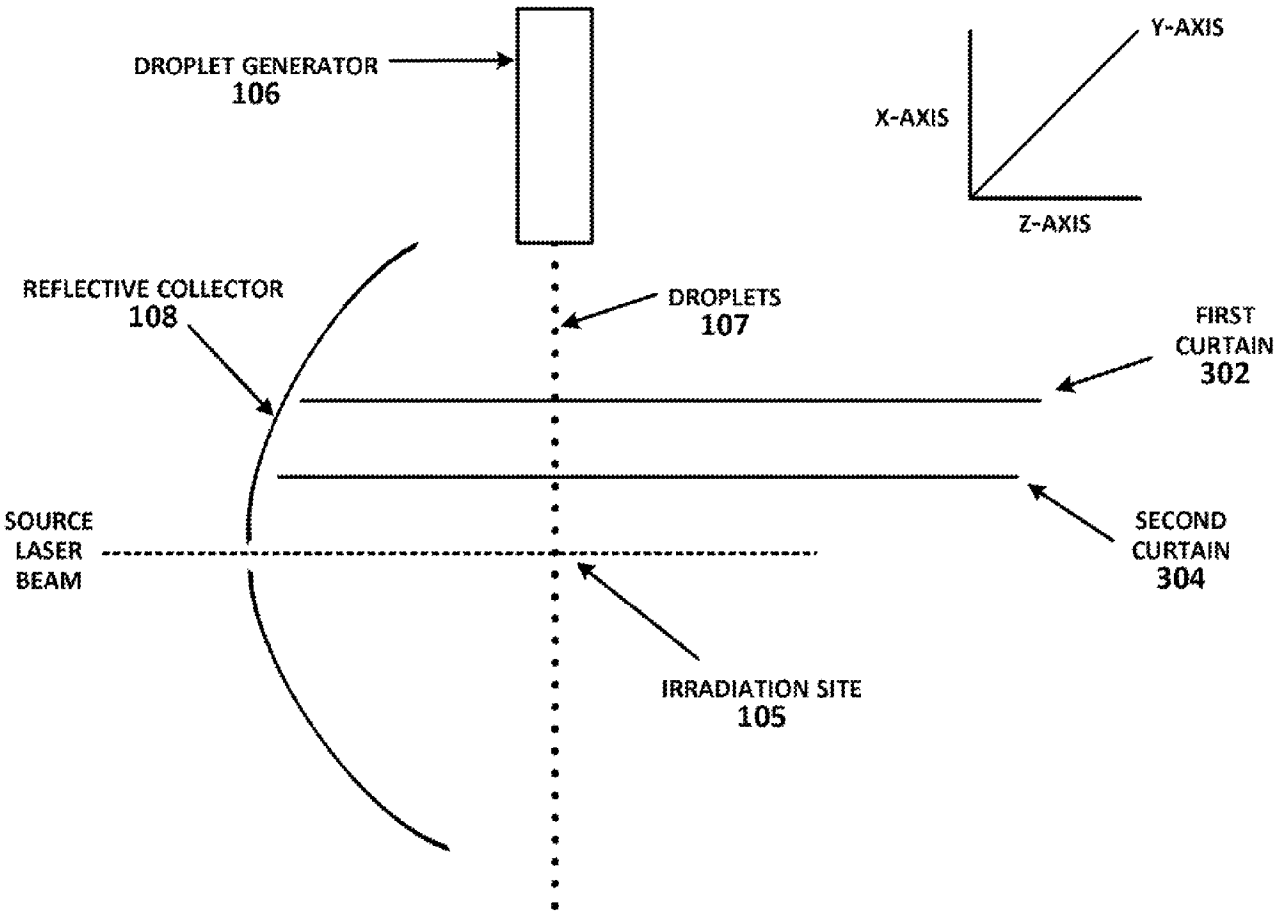
FIGURE 3 (Prior art)
FIG. 3 is another simplified illustration showing some of the components of another prior art embodiment of an LPP EUV system.

As above, in some cases it is desirable to have two curtains. In the prior art, it is known for these curtains to be generated by separate lasers. FIG. 3 is another simplified illustration again showing some of the components of a prior art LPP EUV system such as is shown in FIG. 1, but now with two planar curtains, a first curtain 302 and a second curtain 304, both between droplet generator 106 and irradiation site 105. Curtains 302 and 304 each function similarly to curtain 202 in FIG. 2, generating a flash of laser light reflected from a droplet 107 when it passes through each curtain. Two sensors are typically used to detect the flashes from the respective curtains and provide feedback signals.

As above, the two curtains 302 and 304 are typically at different distances from irradiation site 105. For example, in one embodiment, curtain 302 may be farther from irradiation site 105 than curtain 304; again, both curtains are between droplet generator 106 and irradiation site 105. The use of two curtains may allow for better determination of the trajectory of the droplets 107, and thus for better control of any appropriate corrections to the trajectory. In some embodiments, curtain 302 may be used to control "coarse" steering provided by, for example, stepper motors, as it is further from irradiation site 105, and curtain 304 may be used to control "fine" steering provided by, for example, piezoelectric transducer ("PZT") actuators.

As is known in the art, while the laser curtains have a finite thickness, it is preferable to make the curtains as thin as is practical, since the thinner a curtain is the more light intensity it has per unit of thickness (given a specific laser source), and can thus provide better reflections off the droplets 107 and allow for more accurate determination of droplet position. For this reason, curtains of about 100 microns (measured FWHM, or "full-width at half-maximum," as known in the art) are commonly used, as it is not generally practical to make thinner curtains. The droplets are generally significantly smaller, on the order of 30 microns or so in diameter, and an entire droplet will thus easily fit within the thickness of the curtain. The "flash" of laser light reflected off of the droplet is a function (theoretically Gaussian) that increases as the droplet first hits the curtain, reaches a maximum as the droplet is fully contained within the curtain thickness, and then decreases as the droplet exits the curtain.

As is also known in the art, it is not necessary that the curtain(s) extend across the entire plasma chamber 110, but rather need only extend far enough to detect the droplets 107 in the area in which deviations from the desired trajectory may occur. Where two curtains are used, one curtain might, for example, be wide in the y-direction, possibly over 10 mm, while the other curtain might be wide in the z-direction, even as wide as 30 mm, so that the droplets may be detected regard less of where they are in that direction.

Again, one with skill in the art will understand how to use such systems to correct the trajectory of droplets 107 to insure that they arrive at irradiation site 105. As above, in the case of NoMO systems, this is all that is required, since again the droplets 107 themselves form part of a cavity, along with a light source that is continuously on such as a $CO_2$ laser source, to cause lasing and vaporize the target material.

However, the use of two separate lasers to create curtains 302 and 304 is not particularly efficient. In such implementations, the lasers are typically of different wavelengths, so that the sensors for each curtain may selected to be more responsive to the wavelength of the respective curtain so as to better detect the flashes from droplets passing through the desired curtain, and not those passing through the other curtain. Further, the plasma flashes from the irradiation site 105 contain all wavelengths of light, thus further increasing the possibility of erroneous signals. Finally, the need for two lasers causes further complexity, for example the need for more viewports in the vessel.

In some instances, the laser used to generate a curtain may have a power of up to 50 watts each, which allows for excellent droplet detection. In fact, such power would be sufficient to generate both curtains. A simple beam splitter is not appropriate, since in such a case both curtains would be of the same wavelength and polarization, thus exacerbating the detection issues mentioned above.

In one embodiment this problem is solved by splitting a laser beam from a single laser using a polarizing beam splitter (PBS), resulting in two beams of linear polarization, each polarization being orthogonal to (i.e., offset by 90 degrees from) the other. One beam creates the first curtain 302, while the other beam creates the other curtain 304. Polarizing filters are used in connection with the sensors so that each sensor receives flashes from the appropriate curtain at full intensity, while flashes from the other curtain, and from the plasma at irradiation site 105, are greatly suppressed or eliminated.

In this way, a single laser, and thus a single wavelength, may be used to generate both curtains at high power, providing for speed of detection and signal fidelity, while reducing the complexity of the system, at only a small cost in the addition of some optical components, i.e., the PBS and polarizing filters.

In addition to the above, in MOPA systems, source laser 101 is typically not on continuously, but rather fires laser pulses when a signal to do so is received. Thus, in order to hit discrete droplets 107 separately, it is not only necessary to correct the trajectory of the droplets 107, but also to determine the time at which a particular droplet will arrive at irradiation site 105 and send a signal to source laser 101 to fire at a time such that a laser pulse will arrive at irradiation site 105 simultaneously with a droplet 107.

In particular, in MOPA PP systems, which generate a pre-pulse followed by a main pulse, the droplet must be targeted very accurately with the pre-pulse in order to achieve maximum EUV energy when the droplet is vaporized by the main pulse. A focused laser beam, or string of pulses, has a finite "waist," or width, in which the beam reaches maximum intensity; for example, a $CO_2$ laser used as a source laser typically has a usable range of maximum intensity of about 10 microns in the x- and y-directions.

Since it is desirable to hit a droplet with the maximum intensity of the source laser, this means that the positioning accuracy of the droplet for irradiation by the pre-pulse must be achieved to within about ±5 microns in the x- and y-directions when the laser is fired. There is somewhat more latitude in the z-direction, as the region of maximum intensity may extend for as much as about 1 mm in that direction; thus, accuracy to within ±25 microns is generally sufficient; there is also more latitude at the irradiation site. One of skill in the art will appreciate that other embodiments may have different tolerances than those described herein.

The speed (and shape) of the droplets may be measured as is known in the art, and is thus known; droplets may travel at over 50 meters per second. (One of skill in the art will appreciate that by adjusting the pressure and nozzle size of the droplet generator the speed may be adjusted.) The position requirement thus also results in a timing requirement; the droplet must be detected, and the laser fired, in the time it takes for the droplet to move from the point at which it is detected to the irradiation site.

One embodiment of an improved system and method of droplet detection provides a robust solution for illuminating and detecting the droplets, thus ensuring the correct timing of irradiation of the droplets by the source laser. A high quality droplet illumination laser of adjustable power, efficient light collection of reflections from the droplets, and protection of the aperture through which the droplet illumination laser is introduced into the plasma chamber are combined to achieve this result.

Figure 4:
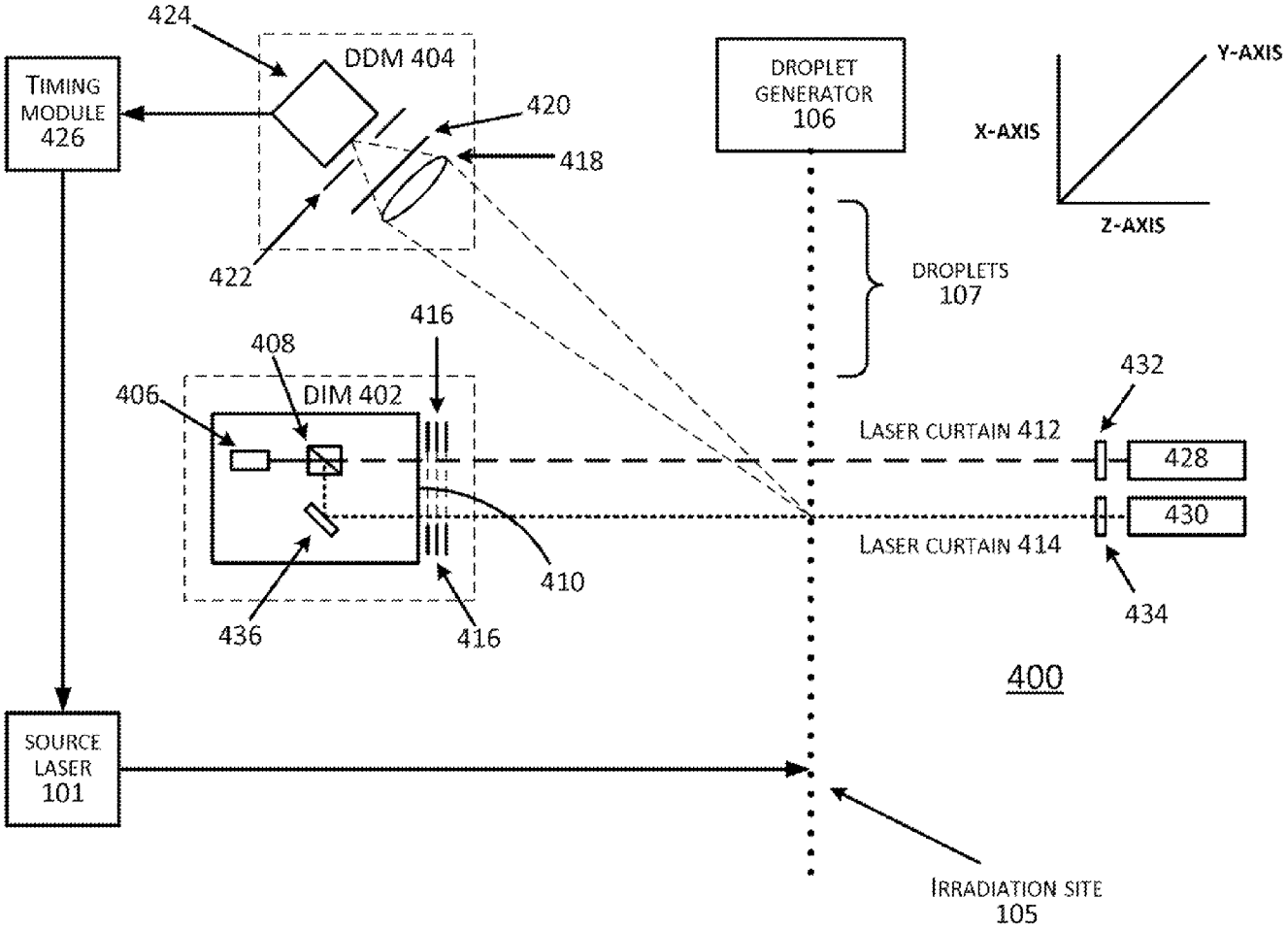
FIG. 4 is a simplified illustration of some of the components of an LPP EUV system including a droplet illumination module and droplet detection module according to one embodiment.

FIG. 4 is a simplified illustration of an LPP EUV system according to one embodiment. System 400 contains elements similar to those in the system of FIG. 1, and additionally includes a droplet illumination module (DIM) 402 and a droplet detection module (DDM) 404. As described above, droplet generator 106 creates droplets 107 which are intended to pass through irradiation site 105, where they are irradiated by pulses from source laser 101. (For simplicity, some elements are not shown in FIG. 4.)

In the illustrated embodiment, DIM 402 contains a single laser source 406 such as a fiber laser with, for example, an output of about 50 watts and a wavelength of 1070 nm. In some embodiments, the laser 406 may also have a built in low power guide laser of, for example, 1 milliwatt and a wavelength of 635 nm. Lasers of different types, wavelengths and power may be used in some embodiments.

The beam from laser source 406 is split by polarizing beam splitter (PBS) 408 into two beams of orthogonal polarization, each beam thus having a power of about 25 watts and a polarization orthogonal to the other beam. One of the beams generates a first laser curtain 412, and the other beam generates a second laser curtain 414, as illustrated by the differing dashed lines in FIG. 4. Optical components such as mirror 436 may be used to direct the beams to the optics (not shown) which create the respective laser curtains. One of skill in the art will appreciate that there are other ways of splitting a beam into two beams of orthogonal polarization, for example, diffractive gratings in reflective designs, sheet polarizers, and optically active crystals, and that each of these will have differing advantages and disadvantages for the desired application.

Both laser curtains 412 and 414 are generally planar, extending primarily in the y-z directions, but again having some thickness in the x-direction. The two curtains 412 and 414 are both located between the droplet generator 106 and irradiation site 105, and are generally perpendicular to, and slightly separated in, the x-direction. In some embodiments, curtain 412 may be located about 10 mm from irradiation site 105, while curtain 414 may be located about 5 mm from irradiation site 105.

The beams from the DIM laser 406 enter the plasma chamber through a viewport 410 in the DIM. The viewport may have a pellicle, i.e., a thin glass element that acts as a protective cover for the viewport, with a coating that transmits the wavelength of the DIM laser 406 and reflects most wavelengths of the scattered light from the source laser 101; this helps to keep the pellicle from heating up as a result of radiative heat from the source laser 101, as well as preventing distortion of the beams from DIM laser 406. The pellicle coating also helps to protect the viewport 410 from target material debris in the chamber.

In addition to the pellicle coating, the DIM also contains a port protection aperture 416 that further protects the pellicle and viewport from target material debris so as to increase the lifetime of the pellicle and viewport and minimize downtime of the EUV system. In the illustrated embodiment, port protection aperture 416 comprises multi-ply-stacked metallic elements, each having a slit that significantly limits the field of view through the viewport to the x-y planes in which the respective laser curtains are to extend.

In one embodiment, the metallic elements of port protection aperture 416 are a plurality of stainless steel plates (stainless steel deforms less due to heat than aluminum), each plate separated from the next by approximately ½ inch or more, and each about 2 mm thick. Three such plates are illustrated in FIG. 4. Each plate extends across viewport 410 in the x- and y-directions, and has a slit that is wide enough in the x- and y-directions to allow DIM laser 406 to project laser curtains 412 and 414. This may be seen by the dashed portions of port protection aperture 416, which represent the slits in the plates. Since there are multiple plates, in some embodiments the plate farthest from the viewport may be as much as one foot away.

Because irradiation site 105 is offset from laser curtains 412 and 414 in the x-direction, i.e., further along the trajectory of droplets 107, debris coming from the direction of the irradiation site 105 will arrive at port protection aperture 416 at an angle to the plates of port protection aperture 416, rather than being perpendicular to the plates as is the case with the beams from DIM laser 406. As a result, any debris that makes it through the slit in the first plate of port protection aperture 416 will not be traveling in a line that would pass directly through the remaining slits, and most of such debris will thus be blocked from reaching viewport 410.

As above, when droplets 107 passes through either curtain 412 or 414, flashes are created by the reflection of the laser energy in the respective curtain off of each droplet 107 and may be detected by sensors. Using beams of different polarization allows the respective sensors that detect flashes from each curtain to be optimized for each polarization and thus enhance detection of flashes from only the curtain corresponding to each sensor.

First laser curtain 412 is generated from one of the beams of orthogonal polarization from DIM laser 406 as above. The flashes created as successive droplets 107 pass through curtain 412 are detected by a first sensor 428, which may be a camera, and which is able to detect the position of droplets 107 in the y-z plane and provide such information to an actuator for droplet generator 106 as feedback to be used for droplet steering as in the prior art and described above. Sensor 428 may utilize a filter 432 which passes the wavelength and polarization of the first beam of DIM laser 406 and absorbs other wavelengths and polarization with a high contrast ratio so as to protect sensor 428 from plasma emissions from irradiation site 105 while allowing accurate detection of flashes from laser curtain 412.

The second laser curtain 414, similarly generated from the other beam of orthogonal polarization from DIM laser 406, also results in flashes when droplets 107 pass through it; these flashes are detected by a second sensor 430, which may again be a camera and similarly provides information about the position of the droplets in the y-z plane. Sensor 430 may similarly utilize a filter 434 which passes the wavelength and polarization of the second beam of DIM laser 406 and absorbs other wavelengths and polarization for protection from plasma emissions. Sensor 430 may use the flashes from curtain 414 to provide for additional control over the trajectory of droplets 107 as in the prior art. In some embodiments, curtain 412 may be used to control a "coarse" adjustment of the droplet steering mechanism, and curtain 414 used to control a "fine" adjustment of droplet steering.

One of skill in the art will appreciate that splitting the beam from laser 406 into two beams of orthogonal polarization and creating laser curtains 412 and 414 from the separate beams has the benefit of limiting crosstalk in image processing, while still allowing each laser curtain to be optimized for its position with respect to the irradiation site. It will also be appreciated that while beams of sufficient power are easily obtained by using a YAG laser with a wavelength of 1070 nm for laser 406, a different wavelength may be selected. However, while commercial silicon based sensors are less sensitive at 1070 nm than some other wavelengths, it is believed that it is also more difficult to find fiber lasers of sufficient power at the wavelengths at which such sensors are most efficient. One of skill in the art will be able to determine whether some other wavelength is more appropriate.

In addition to monitoring the trajectory of the droplets, curtain 414 is also used for timing the firing of the source laser 101 so that a laser pulse arrives at irradiation site 105 at the same time as a droplet 107, and thus that droplet 107 may be vaporized and generate the EUV plasma.

When a droplet 107 passes through curtain 414, the flash created is also detected by DDM 404; however, unlike sensors 428 and 430, DDM 404 does not need to detect the position of the droplet in the y-z plane, since it is used only for timing and not for steering. For proper operation, DDM 404 should only record flashes from droplets 107 passing through curtain 414, and should ignore flashes from curtain 412 or plasma light from irradiation site 105. DDM 404 should thus be configured in a way that it is able to accurately distinguish these various events. In one embodiment, DDM 404 contains a collection lens 418, a spatial filter 420, a slit aperture 422, a sensor 424, and an amplifier board (not shown) to boost a signal from the sensor 424. If desired, DDM 404 may also include a port protection aperture (not shown) constructed in a similar fashion to the port protection aperture 416 shown for DIM 402 above, and located between collection lens 418 and sensor 424.

Collection lens 418 is oriented to collect light from the flashes created when droplets 107 pass through curtain 414 and focus that light on sensor 424, while plasma light from irradiation site 105 will not be focused on sensor 424 in the same way since it is coming from a different direction than from curtain 414. Slit aperture 422 is also oriented such that the light from curtain 414 focused by collection lens 418 will pass through to sensor 424, but plasma light from irradiation site 105 will be slightly further defocused. For further protection of sensor 424, there may be a viewport and pellicle between slit aperture 422 and sensor 424 if desired.

Sensor 424 may be, for example, a silicon diode, and is preferably optimized to detect light at the wavelength and polarization of the first beam from DIM laser 406, for example 1070 nm (or such other wavelength as may be chosen for DIM laser 406), and not light of either the polarization of the other beam of DIM laser 406 or other wavelengths of the plasma light created at irradiation site 105. This configuration and the orientation of collection lens 418 and slit aperture 422 ensures that DDM 404 accurately and reliably detects each flash created when a droplet 107 passes through curtain 414, while ignoring flashes created when a droplet 107 passes through curtain 412 as well as the plasma light created at irradiation site 105.

When such a flash is received by sensor 424, a timing module 426 (e.g., a logic circuit) calculates the time it will take for the droplet 107 that created the received flash to reach irradiation site 105 based upon the distance from curtain 414 to irradiation site 105 and the speed of the droplet, which is again known. Timing module 426 then sends a timing signal to source laser 101 which instructs source laser 101 to fire at a time calculated to result in a laser pulse arriving at irradiation site 105 at the same time as the current droplet 107 so that droplet 107 may be vaporized and create EUV plasma.

In a typical NoMO LLP EUV system, the droplet generator may generate droplets 107 at a rate of 40,000 per second (40 KHz), while a MOPA PP system may use a rate of 50,000 KHz or higher. At a rate of 40,000 KHz, a droplet is thus generated every 25 microseconds. Sensor 424 must thus be able to recognize a droplet and then be prepared to recognize the next droplet within that time period, and timing module 426 must similarly be able to calculate droplet timing and generate and send a timing signal and be waiting for the next droplet to be recognized in the same time period.

Further, if droplets fly at 50 meters per second, and curtain 414 is 5 mm from irradiation site 105, a droplet will reach irradiation site 105 10 milliseconds after it passes curtain 414. Thus, a droplet must be sensed by DDM 404, a timing signal generated by timing module 426, that signal sent to source laser 101, and a pulse fired by source laser 101 in time for the pulse to travel to irradiation site 105 in that 10 milliseconds. In some embodiments, droplets may fly at even faster speeds. A person of ordinary skill in the art will appreciate how this may be done within such a time period, and with sufficient accuracy that the pulse will hit the droplet.

Again, the signal of a droplet 107 passing through a curtain is a Gaussian curve that is determined by the curtain beam shape cross-section. The height and width of the Gaussian curve are a function of the droplet size and velocity, respectively. However, the curtain thickness of 100 microns or more is significantly greater than the droplet size of 30-35 microns, and the actual shape of the droplet can be shown to be irrelevant. Further, the reflection of the droplet while it passes through the curtain is integrated, so that high frequency surface changes of the droplet will average out.

One of skill in the art will also appreciate that while FIG. 4 is shown as a cross-section of the system in the x-z plane, in practice the plasma chamber 110 is often rounded or cylindrical, and thus the components may in some embodiments be rotated around the periphery of the chamber while maintaining the functional relationships described herein.

In another embodiment (not shown), a second droplet detection module may be used, constructed similarly to droplet detection module 404 in FIG. 4, but oriented to receive light and detect flashes from laser curtain 412, rather than laser curtain 414. In such a case, droplet detection module 404 will preferably have a filter which, as filter 434 in FIG. 4, passes the polarization and wavelength of the second beam from laser 406, i.e., the polarization and wavelength of laser curtain 414. The second droplet detection module will similarly preferably have a filter which passes the polarization and wavelength of laser curtain 412, as does filter 432 in FIG. 4. This will allow each of the two droplet detection modules to detect flashes only from the appropriate laser curtain, just as with the use of sensors 428 and 430 and filters 432 and 434 as described above.

Such a configuration with two droplet detection modules allows for both laser curtains 412 and 414 to be used both for detecting droplet trajectory and measuring droplet velocity. This makes it possible to measure the time taken for a droplet to cross the distance between laser curtain 412 and laser curtain 414, thus resulting in a more accurate measurement of the droplet velocity, as well as information about the performance of the droplet generator 106. Further, the timing module 426, which now receives signals from both droplet detection modules, can more accurately calculate droplet velocity and use any deviation from mean velocity over many droplets to update timing signals to source laser 101.

Alternatively, droplet detection module 404 can be oriented in such a way that flashes from both laser curtains 412 and 414 are detected. In such an embodiment, an additional sensor such as sensor 424 would be included in droplet detection module 404, and another PBS such as PBS 408 used to sort the received flashes by their polarization, so that flashes from laser curtain 414 are received by sensor 424 as in FIG. 4, and flashes from laser curtain 412 are received by the additional sensor.

One issue that arises in using the two sensors to determine droplet speed is that if the laser curtains are too far apart, then after a first droplet 107 crosses laser curtain 412, a second droplet 107 (or more, if the curtains are far enough apart) will cross laser curtain 412 before the first droplet 107 reaches laser curtain 414, resulting in a mixed sequence of detection times. In such a case, determining which of the detection times relate to a single droplet is very difficult.

For this reason, in one embodiment laser curtains 412 and 414 are placed closer together than the expected distance between any two sequential droplets 107, so that each droplet may be detected individually when it crosses the laser curtains. The expected distance between two sequential droplets is based upon the rate at which droplets are created and their expected speed. For example, if the droplets are created at a rate of 50 kHz, and travel at 70 meters per second (m/s), laser curtains 412 and 414 must be less than 1.4 mm apart (70 m/s divided by 50,000). This allows a droplet 107 to be detected when it crosses laser curtain 412 and detected again when it crosses laser curtain 414, before another droplet is detected crossing laser curtain 412, resulting in a matched pair of detection moments.

If laser 406 is powerful enough (such as the 50 watt laser described above), since laser curtains 412 and 414 have orthogonal polarization, the use of filters 432 and 434 allows the curtains to be sufficiently close, in this example within 1.4 mm of each other, without affecting the detection of flashes from each curtain by sensors 428 and 430, even if there are near simultaneous flashes from both curtains. (As above, the curtains actually have a Gaussian profile, and thus the detection flashes do as well; if a second droplet 107 hits laser curtain 412 soon after the first droplet 107 hits laser curtain 414, the front end of the flash from laser curtain 412 may overlap with the tail end of the flash from laser curtain 414.)

A configuration with two droplet detection modules 404 (or two sensors 424 within a single module) has another potential advantage. Laser 406 and PBS 408 are mounted in the system, and thus subject to the mechanical tolerances of the hardware used for mounting them. This similarly limits the tolerances within which the positions of laser curtains 412 and 414 may be pre-determined by such mounting. The two sensors 424, whether contained in a single droplet detection module 404 or two such modules, may be used to more accurately determine the position of the laser curtains.

This calibration is accomplished prior to EUV production by removing the polarization filters from the two sensors 424 and allowing a droplet to pass from the droplet generator along the droplet trajectory. As the droplet hits the first laser curtain 412, both sensors 424 will detect the flash created (since the polarization filters are not present) and each will generate a detection signal. There are thus two "equations," i.e., two signals, and two unknown values, i.e., curtain distance and droplet velocity; one of skill in the art will appreciate that this allows for a solution of the curtain distance to a great level of accuracy. A similar process allows determination of the distance to the other laser curtain 414. Once the distances to the laser curtains have been determined, the polarization filters are replaced and operation of the system for EUV production may commence.

Knowing the positions of the laser curtains more accurately allows variations in velocity for each droplet (calculated by using the times when each droplet crosses each curtain) to be taken into account, rather than using an average velocity, and thus also allows timing module 426 to more accurately predict when the source laser 101 should fire in order to irradiate each droplet.

Figure 5:
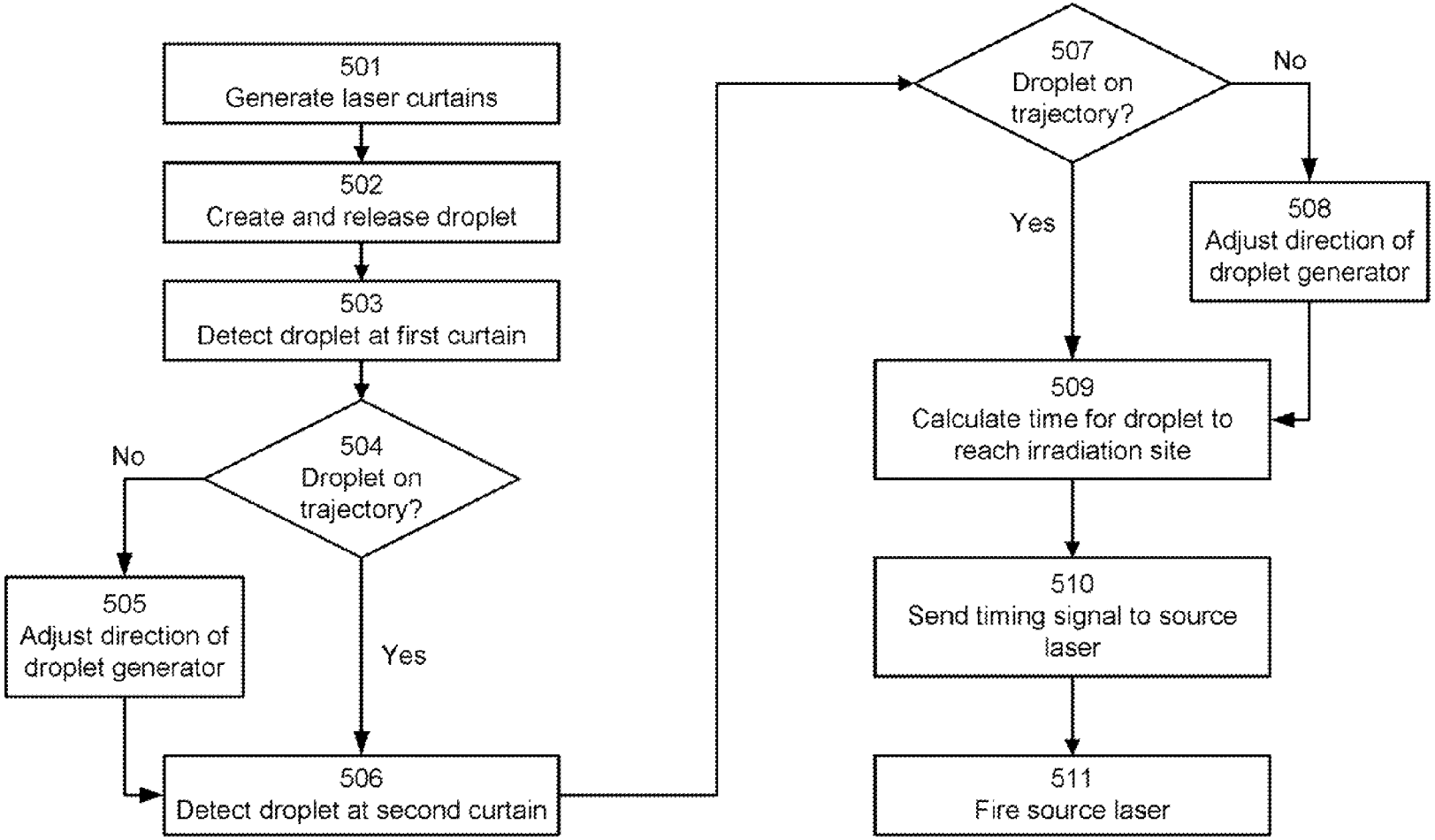
FIG. 5 is a flowchart of a method of timing the pulses of a source laser in an LPP EUV system according to one embodiment.

FIG. 5 is a flowchart of a method that may be used for timing laser pulses in an LPP EUV system, in which a droplet generator produces droplets to be irradiated by a source laser at an irradiation site, such as a MOPA or MOPA PP laser, according to one embodiment as described herein. At step 501, two laser curtains are generated as described above, such as by DIM laser 406 in FIG. 4. As described above, both curtains are located between the droplet generator and the irradiation site at which it is desired to irradiate the droplets to produce EUV plasma.

At step 502, droplets are sequentially created, for example by droplet generator 106, and sent on a trajectory toward the irradiation site. At step 503, a droplet, such as a droplet 107, passes through the first of the two laser curtains, for example laser curtain 412 in FIG. 4, and the droplet is detected by a sensor, such as sensor 428, which detects the flash as the light of the first laser curtain is reflected off of the droplet.

At step 504, a first controller receives from the sensor data regarding the detected flash and from that data determines the position of the droplet in the y-z plane and, from that position, whether the droplet is on the desired trajectory to the irradiation site. If the droplet is not on the desired trajectory, at step 505 a signal is sent to the droplet generator indicating the direction(s) in the y-z plane in which the droplet has deviated from the desired trajectory, so that an actuator for droplet generator 106 may adjust the direction in which the droplet generator releases subsequent droplets to correct the trajectory to the desired trajectory.

Next, at step 506, the droplet is detected by the second curtain, such as laser curtain 414 in FIG. 4. Note that the method continues from the detection of a droplet at the first curtain in step 503 to the detection of the droplet at the second curtain in step 506 even if the droplet is not on the correct trajectory, as the droplets currently in motion cannot be adjusted. The adjustment of the direction in which the droplet generator releases droplets will only affect the trajectory of subsequent droplets.

Again, a sensor such as sensor 430 detects a flash from the droplet as it crosses the second curtain. At step 507, a second controller receives from the sensor data regarding the detected flash and from that data again determines the position of the droplet in the y-z plane and whether that position places the detected droplet on the desired trajectory to the irradiation site. If the droplet is not on the desired trajectory, at step 508 again a signal is sent to the droplet generator indicating the deviation from the desired trajectory so that an adjustment may be made to the direction in which the droplets are released to correct the droplet trajectory. As above, in some embodiments the signal sent in step 505 may be for a "coarse" adjustment of the droplet trajectory and the signal sent in step 508 for a "fine" adjustment of the droplet trajectory.

In addition, once a droplet has been detected crossing the second laser curtain, based upon the speed of the droplet and the distance from the second curtain to the irradiation site, at step 509 a third controller, such as timing module 426 in FIG. 4, calculates the time at which the detected droplet will reach the irradiation site, and at step 510 sends a timing signal to the source laser instructing the source laser to fire at such a time that the laser pulse will reach the irradiation site at the same time as the droplet in question. At step 511, the source laser fires a pulse at the time specified by the timing signal, and the pulse irradiates the droplet at the irradiation site.

As with the detection of the droplet by the second laser curtain at step 506 even if the droplet was not on the correct trajectory at step 504, steps 509 to 511 are performed even if it has been determined that the droplet is not on the correct trajectory at step 507 since as above the trajectory of the droplets already released cannot be altered. As with the adjustment of droplet trajectory at step 505, the adjustment of droplet trajectory at step 508 will only affect the trajectory of droplets subsequently released.

Note that this flowchart shows the treatment of a single droplet. In practice, the droplet generator is continuously generating droplets as described above. Since there is a sequential series of droplets, there will similarly be a sequential series of flashes detected, and a series of timing signals generated, thus causing the source laser to fire a series of pulses and irradiating a series of droplets at the irradiation site to create the EUV plasma. Further, as above, it is expected that in most embodiments these functions will overlap, i.e., a droplet may pass through the second curtain every 25 microseconds or faster, while it may take about 10 milliseconds for each droplet to pass from the second curtain to the irradiation site. Thus, the second controller should include a queuing function which allows for the detection of, and an appropriate timing signal for, each separate droplet.

In some embodiments, the first and second controllers (not shown in FIG. 4) and the third controller (such as timing module 426) may be logic circuits or processors. In some embodiments, a single control means, such as a processor, may serve as both the first and second controllers, while in other embodiments a single control means may serve as all three controllers.

The disclosed method and apparatus have been explained above with reference to several embodiments. Other embodiments will be apparent to those skilled in the art in light of this disclosure. Certain aspects of the described method and apparatus may readily be implemented using configurations other than those described in the embodiments above, or in conjunction with elements other than those described above.

For example, different algorithms and/or logic circuits, perhaps more complex than those described herein, may be used. While certain examples have been provided of various configurations, components and parameters, one of skill in the art will be able to determine other possibilities that may be appropriate for a particular LPP EUV system. Different types of source lasers and line lasers, using different wavelengths than those described herein, as well as different sensors, focus lenses and other optics, or other components may be used. A single laser may be used to provide two laser curtains of orthogonal polarization in prior art systems having two curtains used for conventional purposes as described herein. Finally, it will be apparent that different orientations of components, and distances between them, may be used in some embodiments.

It should also be appreciated that the described method and apparatus can be implemented in numerous ways, including as a process, an apparatus, or a system. The methods described herein may be implemented in part by program instructions for instructing a processor to perform such methods, and such instructions recorded on a computer readable storage medium such as a hard disk drive, floppy disk, optical disc such as a compact disc (CD) or digital versatile disc (DVD), flash memory, etc. In some embodiments the program instructions may be stored remotely and sent over a network via optical or electronic communication links. It should be noted that the order of the steps of the methods described herein may be altered and still be within the scope of the disclosure.

These and other variations upon the embodiments are intended to be covered by the present disclosure, which is limited only by the appended claims.

What is claimed is:

1. A system for timing the firing of a source laser in an extreme ultraviolet laser produced plasma (EUV LPP) light source having a droplet generator which releases a droplet at an estimated speed, the source laser firing pulses at an irradiation site, comprising:

a droplet illumination module comprising a single line laser configured to generate a first laser curtain and a second laser curtain, the first and second laser curtains being of orthogonal polarizations and each located between the droplet generator and the irradiation site;

a droplet detection module comprising a first sensor configured to detect a first curtain flash when the droplet passes through the first laser curtain;

a first controller configured to:

determine, based upon the first curtain flash as detected by the first sensor, a known distance from the first curtain to the irradiation site, and the estimated speed of the droplet, a time when the source laser should fire a pulse so as to irradiate the droplet when the droplet reaches the irradiation site; and generate a timing signal instructing the source laser to fire at the determined time;

a second sensor configured to detect a second curtain flash when the droplet passes through the second laser curtain; and a second controller configured to determine, based upon the second curtain flash as detected by the second sensor, that the droplet is not on a desired trajectory leading to the irradiation site and providing a signal indicating an adjustment to a direction in which the droplet generator releases a subsequent droplet which will place the subsequent droplet on the desired trajectory.

2. The system of claim 1, wherein the system further comprises:

a third sensor configured to detect the first curtain flash from the first laser curtain when the droplet passes through the first laser curtain; and a third controller configured to determine, based upon the first curtain flash as detected by the third sensor, that the droplet is not on the desired trajectory leading to the irradiation site and providing a signal indicating an adjustment to the orientation of the droplet generator which will place a subsequent droplet on the desired trajectory.

3. The system of claim 1 wherein the droplet illumination module further comprises a viewport between the line laser and the desired trajectory of the droplet.

4. The system of claim 3 wherein the droplet illumination module further comprises a port protection aperture for protecting the viewport.

5. The system of claim 4 wherein the port protection aperture comprises a plurality of separated metallic elements.

6. The system of claim 1 wherein the droplet illumination module further comprises a polarizing beam splitter configured to split a beam from the line laser into two beams having polarizations orthogonal to one another.

7. The system of claim 1 wherein the droplet detection module further comprises a collection lens for collecting light from the first curtain flash from the droplet passing through the first laser curtain and focusing the light onto the first sensor.

8. The system of claim 1 wherein the droplet detection module further comprises a slit aperture between the collection lens and the first sensor.

9. The system of claim 1 wherein the droplet detection module further comprises a port protection aperture for protecting the first sensor.

10. The system of claim 8 wherein the port protection aperture comprises a plurality of separated metallic elements.

11. The system of claim 2 wherein the line laser is configured to generate the first laser curtain and second laser curtain such that the first laser curtain is closer to the irradiation site than the second laser curtain.

12. The system of claim 11 wherein the line laser is further configured to generate the first laser curtain and second laser curtain such that the first laser curtain is closer to the second laser curtain than the expected distance between the droplet and a subsequent droplet released by the droplet generator.

13. The system of claim 1 wherein the second sensor further comprises a filter configured to allow light of the wavelength of the line laser and polarization of the second laser curtain to pass and to absorb light of other wavelengths and polarization.

14. The system of claim 2 wherein the third sensor further comprises a filter configured to allow light of the wavelength of the line laser and polarization of the first laser curtain to pass and to absorb light of other wavelengths and polarization.

15. The system of claim 1 further comprising a second droplet detection module comprising:

a further sensor configured to detect the second curtain flash when the droplet passes through the second laser curtain; and a further controller configured to communicate to the first controller when the second curtain flash is detected by the further sensor.

16. The system of claim 15 wherein the first controller is further configured to adjust the estimated speed of the droplet based upon when the second curtain flash is detected by the further sensor.

17. A method for timing the firing of a source laser in an EUV LPP light source having a droplet generator which releases a droplet at an estimated speed, the source laser firing pulses at an irradiation site, comprising:

generating from a single laser source a first laser curtain and a second laser curtain, the first and second laser curtains having polarizations orthogonal to each other and located between the droplet generator and the irradiation site;

detecting by a first sensor a first curtain flash when the droplet passes through the first laser curtain;

determining from the first curtain flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory;

detecting by a second sensor a second curtain flash when the droplet passes through the second laser curtain; and determining, based upon the second curtain flash as detected by the second sensor, a known distance from the first curtain to the irradiation site, and the estimated speed of the droplet, a time when the source laser should fire a pulse so as to irradiate the droplet when the droplet reaches the irradiation site, and generating a timing signal instructing the source laser to fire at the determined time.

18. The method of claim 17, further comprising:

detecting by a third sensor the first curtain flash when the droplet passes through the first laser curtain; and determining from the first curtain flash as detected by the third sensor that the droplet is not on the desired trajectory leading to the irradiation site and providing a signal indicating an adjustment a direction in which the droplet generator releases a subsequent droplet which will place the subsequent droplet on the desired trajectory.

19. A non-transitory computer readable storage medium having embodied thereon instructions for causing a computing device to execute a method for timing the firing of a source laser in an EUV LPP light source having a droplet generator which releases a droplet at an estimated speed, the source laser firing pulses at an irradiation site, the method comprising:

generating from a single laser source a first laser curtain and a second laser curtain, the first and second laser curtains having polarizations orthogonal to each other and located between the droplet generator and the irradiation site;

detecting by a first sensor a first curtain flash when the droplet passes through the first laser curtain;

determining from the first curtain flash as detected by the first sensor that the droplet is not on a desired trajectory leading to the irradiation site and providing a signal indicating an adjustment to a direction in which the droplet generator releases a subsequent droplet which will place the subsequent droplet on the desired trajectory;

detecting by a second sensor a second curtain flash when the droplet passes through the second laser curtain; and determining, based upon the second curtain flash as detected by the second sensor, a known distance from the first curtain to the irradiation site, and the estimated speed of the droplet, a time when the source laser should fire a pulse so as to irradiate the droplet when the droplet reaches the irradiation site, and generating a timing signal instructing the source laser to fire at the determined time.

* * * * *